United States Patent [19]

Housand, Sr

[11] Patent Number: 5,002,033

[45] Date of Patent: Mar. 26, 1991

[54] FUEL SYSTEM FOR INTERNAL COMBUSTION ENGINE

[76] Inventor: Raymond W. Housand, Sr, 22875 - 22 Mile Rd., Paris, Mich. 49338

[21] Appl. No.: 470,370

[22] Filed: Jan. 25, 1990

[51] Int. Cl.[5] ..... F02B 33/00

[52] U.S. Cl. ..... 123/522; 123/1 A

[58] Field of Search ..... 123/522, 523, 1 A

[56] References Cited

U.S. PATENT DOCUMENTS

| | | | |
|---|---|---|---|
| 3,800,768 | 4/1974 | Rhodes et al. | 123/522 |
| 3,816,083 | 6/1974 | Patterson | 123/1 A |
| 3,919,988 | 11/1975 | Bun | 123/1 A |
| 4,011,847 | 3/1977 | Fortino | 123/522 |
| 4,220,127 | 9/1980 | Reynolds | 123/522 |
| 4,384,551 | 5/1983 | Scott | 123/1 A |
| 4,397,286 | 8/1983 | Jackson et al. | 123/523 |
| 4,426,984 | 1/1984 | Gilbert | 123/522 |
| 4,499,864 | 2/1985 | Lovercheck et al. | 123/1 A |
| 4,858,582 | 8/1989 | Brown | 123/523 |

*Primary Examiner*—Andrew M. Dolinar
*Assistant Examiner*—M. Macy
*Attorney, Agent, or Firm*—Price, Heneveld, Cooper, DeWitt & Litton

[57] ABSTRACT

An apparatus for preparing and supplying a mixture of fuel, air and combustion supporting particles to an internal combustion engine for use therein. A first chamber open to the atmosphere is used to contain a controlled amount of liquid fuel, a portion of which is vaporized by an ultrasonic transducer to produce a mixture of vaporized fuel and air. A second chamber open to the atmosphere, and in fluid communication, is used to contain a supply of combustion supporting particles mixed with liquid fuel. Air enters the second chamber and pours through the mixture of fuel and carburetor supporting particles to produce a vaporized mixture of fuel, air and combustion supporting particles. The output of the first and second chambers are mixed together and supplied on demand to the mixed fuel and air mixture flowing from the carburetor into the engine to enhance the performance of the engine. An improved internal combustion engine is also disclosed, as well as the method of improving the performance of the internal combustion engine.

17 Claims, 1 Drawing Sheet

FUEL SYSTEM FOR INTERNAL COMBUSTION ENGINE

BACKGROUND OF THE INVENTION

It has been known for many years that the fuel supplied to an internal combustion engine is not completely consumed in the operation of the engine. A substantial percentage of the fuel is carried completely through the engine and exits from the exhaust system. This unused fuel not only wastes the money of the operator of the motor vehicle but also adds to the air pollution problem.

The federal government and many states have passed laws substantially restricting the emissions from the exhaust system of an internal combustion engine. In order to comply with these federal and state requirements, the internal combustion engine used in motor vehicles have been adjusted to burn a very lean mixture of fuel and air. While this reduces the amount of fuel used in the engine, and in turn the amount carried through the engine, it also has the effect of providing a cooler combustion mixture. The low amount of fuel used in each charge to the cylinder of the engine causes the engine to tend to misfire and to not properly burn all of the fuel. There are insufficient fuel particles to carry the flame front throughout the cylinder to consume all of the fuel particles contained therein. The remaining fuel passes out through the exhaust system where catalytic means are used to consume the fuel to reduce the noxious emission products produced in the operation of the engine.

Since the amount of fuel contained in each charge to the cylinder is reduced, the natural consequence is that the amount of energy produced by each firing of the cylinder containing the lean fuel/air mixture is also reduced. The overall output, then, of the engine is diminished due to the consequences of adjusting the engine to use less fuel per cylinder charge. If something could be done to improve the percentage of fuel consumed in each cylinder charge, the output energy from the engine would be increased and the amount of unused fuel passing through the engine would be substantially reduced. The desirable outcome would be improved engine performance and reduced air pollution.

Many attempts have been made to improve the operation of internal combustion engines by applying energy of some form to the fuel or fuel/air mixture. For example, U.S. Pat. No. 3,940,407 applies pulses of electrical energy to the air input stream to the engine to generate ions which are then mixed with the fuel for the engine. The ions are alleged to increase the performance of the engine. U.S. Pat. No. 3,976,726 applies pulsed energy to the liquid fuel stream entering the carburetor at the resonant frequency of the molecular components of the fuel to activate the fuel and in turn, enhance the performance of the engine. U.S. Pat. No. 4,138,980 applies RF energy to the combustible plasma air/fuel mixture in the combustion chamber to excite at least one resonant mode to enhance preconditioning and combustion of the fuel in the engine. U.S. Pat. No. 4,401,089 employs an ultrasonic transducer in the engine manifold to vaporize the fuel prior to entry of the fuel/air mixture into the cylinders. U.S. Pat. No. 4,556,020 employs an ultraviolet lamp in the combustion chamber which dissociates oxygen molecules in the flame front to stimulate combustion of the flame to allow the burning of lean fuel/air mixtures.

Of particular interest to the present invention is U.S. Pat. No. 4,338,905 which employs a vaporization chamber using resistive heating and an ultrasonic transducer to vaporize fuel. The vaporized fuel is then fed to the PCV input to the carburetor where the vaporized fuel is added to the conventional carbureted fuel/air mixture to increase the efficiency of operation of the engine.

SUMMARY OF THE INVENTION

In accordance with the present invention, an improved fuel system is provided for use with internal combustion engines. The improved fuel system enables the internal combustion engine to obtain substantially complete combustion of the fuel in each charge to a cylinder; reduces the amount of unused fuel exiting the engine; enables the flame front to propagate through the fuel in each cylinder and increases the energy output from each fuel charge in each cylinder. In the improved fuel system, a mixture of vaporized fuel, air and combustion supporting particles are added to the carbureted fuel/air stream entering the engine. The combustion supporting particles enter each cylinder, along with the fuel and air, and on ignition of the charge in the cylinder, the particles tend to enhance the combustion of the fuel improving the performance of the engine and decreasing the amount of unused fuel exhausted from each cylinder.

In accordance with an embodiment of the present invention, a chamber is provided for preparing a mixture of vaporized fuel and air for use in the internal combustion engine. A second chamber is also provided for preparing a mixture of vaporized fuel, air and combustion supporting particles. The output of the two chambers are mixed and the resulting mixture is supplied to the fuel/air mixture prepared by the carburetor of the internal combustion engine. The resulting mixture is conveyed to the cylinders of the internal combustion engine and provides for each charge to the cylinder a mixture of fuel, air and combustion supporting particles, with the result being more complete combustion of the fuel in the cylinder and the reduction in the amount of unburned fuel exhausted from the cylinder.

DETAILED DESCRIPTION OF THE PREFERRED EMBODIMENTS

Figure 1:
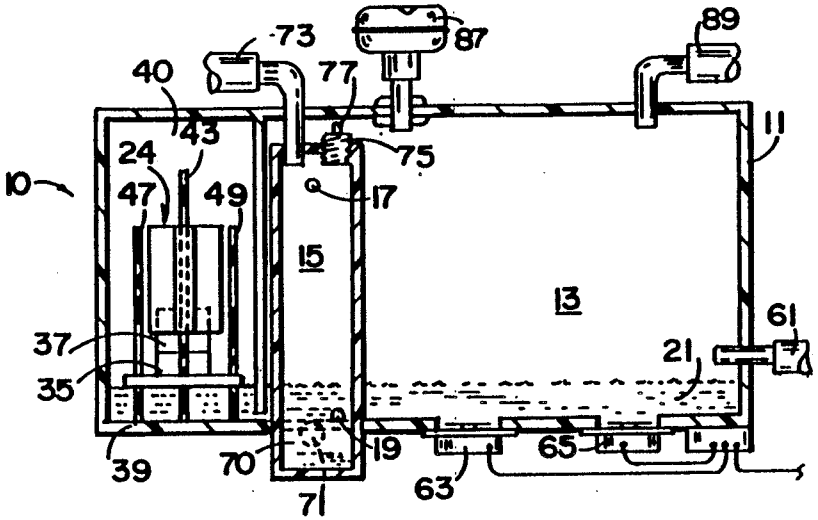
FIG. 1 is a sectional view showing the fuel vaporization chamber, the particulate supply chamber and the fuel level control.
Figure 2:
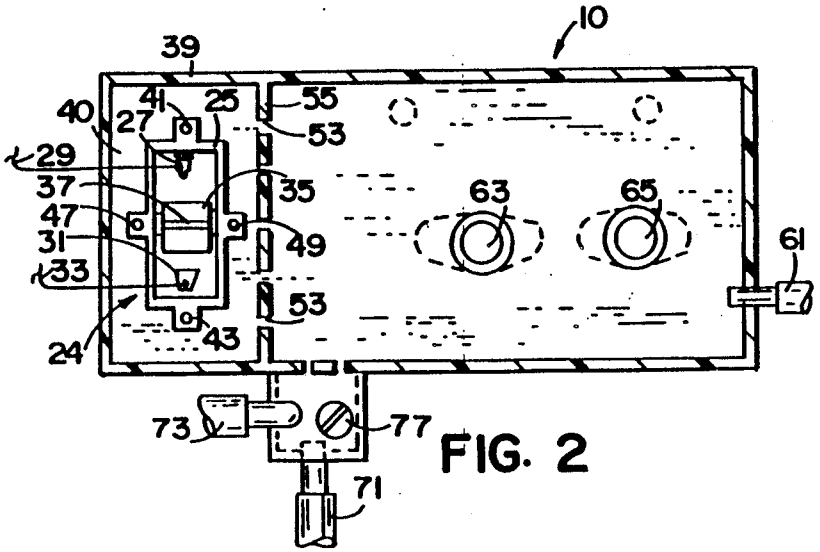
FIG. 2 is a plan view of the device of FIG. 1.

Referring to FIGS. 1 and 2, the fuel system of the present invention is shown and indicated generally by the number 10. The device is made up of a housing 11 which is divided into a major chamber 13 and a minor chamber 15 with the two chambers being connected together. The vapor space of the chamber 13 is connected to the vapor space of the chamber 15 by means of the port 17 in the wall separating the two chambers. The two chambers are at the same pressure. A second port 19 connects the liquid fuel 21 in the major chamber 13 to the minor chamber 15 so that the fuel levels throughout the fuel system 10. The housing 11 is of a substantially rectangular configuration having a length of approximately 11 inches, a width of approximately 4 inches, and a depth of approximately 5 inches. The minor chamber 15 is substantially square in cross section and is approximately 2 inches by 2 inches with a length of approximately 7 inches. The bottom of the minor chamber is approximately 2½ inches below the bottom of the major chamber. The housing 11, including the chambers 13 and 15, can be made of any material compatible with the fuel used in the internal combustion engine. It can be made of metal, such as copper and aluminum, or it can be made of plastic such as Plexiglas. In the experimental phase of the present invention, the housing was made of Plexiglas. While Plexiglas was suitable for experimentation, its use in a working embodiment is questionable.

The level of the fuel 21 in the major chamber 13 and minor chamber 15, is maintained by a level control indicated generally by the number 24. The level control has a rectangular open box-like member 25 (FIG. 2) which has supported on one inner wall at least one light emitting diode 27 which is electrically connected to a power source by means of a conductor 29. At the opposite end of the box 25 is mounted a photo cell 31 which is electrically connected to the conductor 33. A light path exists between the light emitting diode 27 and the photo detector 31. In order to control the level of the fuel in the housing 11, a float 35 is provided upon which is mounted a vertically upstanding shutter member 37. The box 25 is held in position near the bottom 39 of the fuel level control chamber 40 by means of spaced vertically upstanding guide pins 41 and 43 which are fastened to the bottom 39. The pins 41 and 43 are preferably made of metal such as a brass, bronze or aluminum rod. In order to control the level of fuel within the housing 11, a float 35 is provided and is guided by a pair of vertically upstanding pins 47 and 49, similar to the pins 41 and 43. By the use of the pins to guide the float 35, the float is centered in position in the optical path between the light emitting diode 27 and the photo detector 31. An opaque shutter member 37 is provided on the float and is raised and lowered to interrupt the light path within the level sensing device. The level of the fuel 21 in the major chamber 13 is the same as the level of the fuel in the control chamber 40 since the fuel passes freely through a plurality of apertures 53 in the bottom of the wall 55 separating a major chamber 13 from the level control chamber 40. The level of the fuel 21 in the major chamber 13 is maintained at approximately ¾ inch. It has been found through experimentation that the fuel system works much better if a fresh supply of gasoline is maintained within the fuel system 10. The fuel level is controlled by the level sensor so that as the fuel is vaporized and exits the chambers 13 and 15, a fresh supply of liquid gasoline is added to the chambers.

Figure 4:
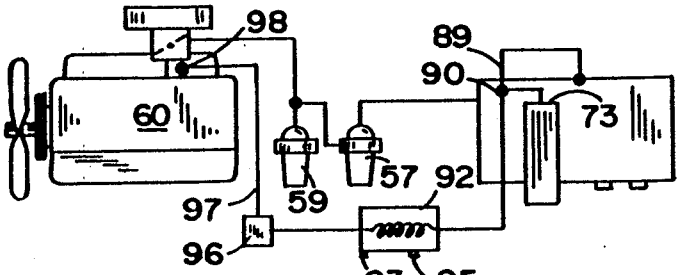
FIG. 4 is a schematic view showing the several components of the present invention connected to an internal combustion engine.

The electrical output from the photo detector 31 on conductor 33 is used to control a relay which in turn controls the operation of an auxiliary fuel pump 57 (FIG. 4), which takes a small portion of the fuel being supplied to the engine by the fuel pump 59 A conventional electric fuel pump is used for the auxiliary pump. The amount of fuel withdrawn by the auxiliary fuel pump 57 is insufficient to affect the operation of the fuel pump 59 and the engine 60. The fuel leaves the fuel pump 57 and is supplied to the fuel intake 61 (FIG. 1) for the vaporization chamber.

As mentioned previously, the fuel system 10 was manufactured of Plexiglas for experimental purposes. Since an optical system was used for the fuel level control, it was necessary that the walls of the fuel level control chamber 40 be opaque. The walls were coated on the outside with a compatible p int in order to preclude light from entering the chamber and interfering with the control system. This, obviously, would be unnecessary if the fuel system were made of metal or of an opaque plastic material. Also, while an optical system has been used in the experimental embodiments of the present invention, it is obvious that other systems can be used to control the level of the fuel. For example, capacitive sensors can be used, a float valve system can be used, and it is also within the scope of the present invention to use an electronic system such as a digital electronic computer with appropriate transducers to sense and control the level of the fuel.

In order to provide adequate fuel vapor in the master chamber 13, a pair of ultrasonic transducers 63 and 65 are mounted in the bottom wall of the chamber in immediate fluid contact with the fuel in the chamber. Suitable sealing material is used to prevent any gasoline from escaping around the transducers. The transducers are available from TDK Inc. of Indianapolis, Ind., and are a type NB-82E-01, which operate at a frequency of approximately 2.35 to 2.6 MHz. The ultrasonic transducers are provided with the necessary drive circuitry and merely need to be connected to an appropriate source of DC power and grounds. It was noted in the operation of the transducers that a voltage dropping resistor of approximately 100 Ohms was necessary in the DC power supply line in order to obtain stable operation of the ultrasonic transducers. The need for this resistor can obviously be determined on an experimental basis and may be incorporated into the transducer drive circuitry so that a separate discrete component would not be required. As previously mentioned, it is important to the operation of the system to frequently or continuously supply fresh gasoline to the master fuel chamber 13 in order for the device to operate at its full potential. It was noted that if the gasoline was allowed to remain in the master chamber 13 for an extended period of time, during which time it was subjected to the output of the ultrasonic transducers, that the gasoline appeared to change or lose a measure of its energy potential. It is preferred to maintain the fuel level low in the fuel system so that the supply of gasoline is frequently changed by vaporization during the course of the operation of the internal combustion engine.

The chamber 15, attached to the side of the housing 11, adjacent the master chamber 13, is used to contain a supply of particulate material 70 which is wet by the fuel or gasoline 21 in the fuel system. An air intake line 71 supplies atmospheric air to the bottom of the chamber 15, below the level of the fuel particulate mixture, so that air bubbles entering at atmospheric pressure will pass upward through the fuel particulate mixture causing the fuel to vaporize and entrain solid particles which are then carried up and out of the chamber 15, through the line 73, disposed in the top of the chamber. Fresh particulate material can be added to the chamber 15 through the threaded port 75 which is closed by the threaded plug 77.

The preferred particulate material for use in the fuel system of the present invention is powdered aluminum which is available from the Aldridge Chemical Company in Wisconsin. The aluminum powder is of a 9 micron particle size. It has been noted that the fuel particles generated in the fuel system, and particularly in the master chamber 13, are also 9 micron in size. Other metals have been tried in the fuel system with varying degrees of success. For example, powdered palladium metal was tried and found to produce results better than that obtained with the powdered aluminum. It is obvious, however, that the powdered aluminum is substantially less expensive than powdered palladium and, for that reason, it is the preferred material. The fuel system would also be expected to work with powdered copper, brass, bronze, and even with non-metallic materials which can heat rapidly in the combustion chamber. The particulate material can also be a mixture of different metals or materials. The particular additive to be used in the fuel system can be determined through experimentation. As mentioned previously, 9 micron aluminum powder was found to produce very good results in the operation of the system and, in view of its ready availability, lower expense and ease of handling is the preferred material. It is expected from experimental data already obtained that approximately 6 ounces of the aluminum powder will provide approximately 20,000 miles of improved engine performance.

Figure 3:
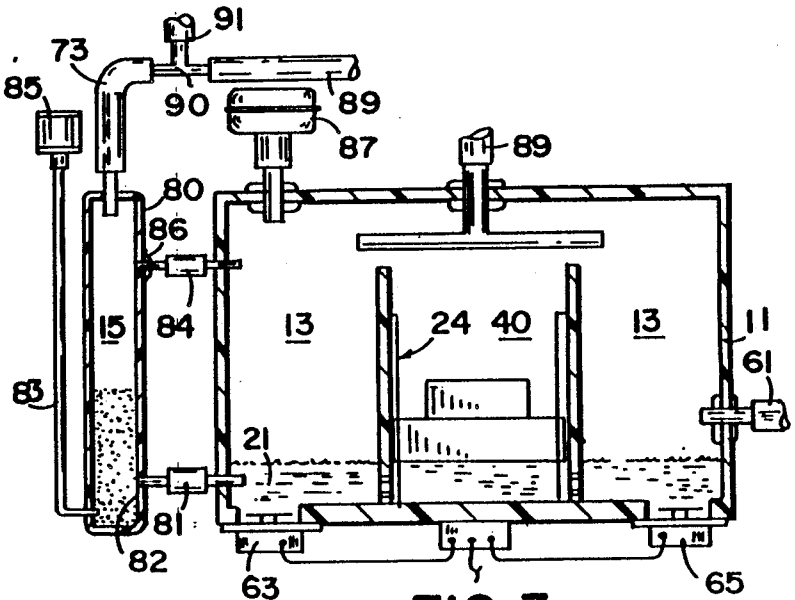
FIG. 3 is a sectional view of a second embodiment of the present invention having the fuel level control centrally disposed in the fuel vaporization chamber and with the particulate supply being an external pouch.

Now referring to FIG. 3, a second embodiment of the fuel system is shown which uses components essentially the same as those used in the embodiment of FIG. 1. In this embodiment, the transducers 63 and 65 have been separated and the fuel level control chamber 40 and fuel level control 24 have been centrally located in the housing 11. In effect, the vaporization chamber 13 of FIG. 1 has now been broken into two smaller vaporization chambers. The particulate supply chamber 15 has been changed in the fuel system of FIG. 3 and has been replaced with a flexible pouch 80 which is fastened to the side of the housing 11 with suitable fasteners (not shown). The use of the pouch 80 substantially simplifies the replacement of the particulate material. In the fuel system of FIG. 1, the plug 77 must be removed from the top of the chamber 15 and then the particulate material added through the port 75. In the embodiment of FIG. 3, the pouch 80 contains several ounces of particulate material and is fastened to the side of the housing 11 with the fuel supply connected through a suitable tube 81 into a passage 82 into the bottom or lower portion of the pouch 80 and with a source of atmospheric air 83 having an air cleaner or filter 85 is provided for bubbling, vaporizing and entraining particulate material which would be carried upward and out of the flexible pouch through the tube 73. The vapor space of the pouch 80 is connected to the vapor space of the chamber 13 by means of a tube 84 and a mating connector 86 on the side of the pouch.

In the operation of the device of the present invention, the fuel system 10 is connected by PCV valve 87 (FIGS. 1 and 3) to the atmosphere. The PCV valve provides a one-way valve open to the atmosphere to protect the housing from damage under high fuel vapor demand conditions. The output of the major chamber 13 is taken from the tube 89 (FIG. 4) which is connected through a suitable connection 90 to the tube 73 from the particulate supply chamber and the combined output is passed through the tube 91 to the heat exchanger 92 which tends to maintain the vaporized state of the fuel. The heat exchanger 92 can be heated with fluid from the engine block which can enter port 93 and exit port 95. The heat exchanger can be made of any suitable combination of materials; for example, during the experimental phase, a copper tubing of approximately ⅜ inch diameter was coiled and placed into a section of PVC plastic tubing. An input and output was provided on the plastic tubing so that hot water from the engine could circulate through the heat exchanger to heat the copper coil. The output of the heat exchanger 92 is passed through a check valve 96 having a five pound pressure which protects the fuel system from the high vacuum that exists at idle or under throttled down conditions. The fuel line 97 is connected to the PCV input 98 which is mounted below the fuel jets and butterfly valve in the carburetor of the internal combustion engine. In cold weather it has been found that the vaporized fuel improves the starting of the engine. Once the system has warmed up and the supply of fuel vapor, air and particulate material is passed to the engine, the overall performance of the engine is substantially improved. It should be noted that the aforementioned combination is added below the fuel jets and butterfly valve of the carburetor so that there is no danger of any particulate material passing upwardly into the carburetor to interfere with the normal operation of the carburetor and the internal combustion engine.

The fuel system of the present invention is a demand type system. When the accelerator is depressed calling for more power from the engine, the volume of air being drawn through the carburetor and at the PCV input increases, causing more vaporized fuel, air and combustion supporting particles to be drawn into the fuel manifold of the engine. The amount of vaporized fuel, air and particulate material entering the engine is related to the vacuum created by the engine.

It has been observed experimentally that the fuel system of the present invention substantially increases the output energy available from the internal combustion engine while, at the same time, substantially reduces the output of unused fuel in the exhaust system. A gas analysis of the exhaust products from the engine showed that the fuel efficiency increased approximately fifty percent. A significant drop was observed in the amount of fuel, carbon monoxide and oxygen present in the exhaust gases. It is believed by the inventor at this time that the particles of particulate material become heated in the course of the combustion in the cylinder and provide active sites for the complete combustion of all of the fuel in the charge to the cylinder of the engine. It is also believed that the aluminum powder undergoes oxidation in the cylinder and exits the cylinder as harmless aluminum oxide particulate material.

Though the invention has been described with respect to a specific preferred embodiment thereof, many variations and modifications will become apparent to those skilled in the art. It is therefore the intention that the appended claims be interpreted as broadly as possible in view of the prior art to include all such variations and modifications.

The embodiments of the invention in which an exclusive property or privilege is claimed are defined as follows:

1. An improved internal combustion engine comprising:

an engine;

a carburetor having at least one fuel jet and an air inlet for supplying a mixture of fuel and air to a passage extending through said carburetor, said mixture being drawn through said carburetor by the vacuum created by said engine;

an inlet to said passage through said carburetor having a vacuum applied thereto by the operation of said engine;

a source of a mixture of vaporized fuel, air and combustion supporting particles connected to said inlet for supplying said mixture to said passage in said carburetor, said source comprising:

a major chamber open to the atmosphere for containing a supply of liquid fuel;

a device for controlling the level of liquid fuel in said major chamber;

at least one transducer for applying energy to said fuel in said major chamber for causing a portion of said fuel to vaporize and mix with the air in said major chamber;

an outlet from said major chamber connected to said inlet;

a minor chamber open to the atmosphere and connected to the output of said major chamber for containing a mixture of combustion supporting particles and a liquid fuel;

an air intake to said minor chamber for causing air to pass through said mixture of combustion supporting particles and liquid fuel to form a mixture of vaporized fuel, air and combustion supporting particles which is mixed with and dispersed throughout said vaporized fuel from said major chamber and supplied to said carburetor inlet; and a source of fuel for said carburetor and for said source of a mixture of vaporized fuel and combustion supporting particles.

2. A device for improving the performance of a carburetor equipped internal combustion engine having a vacuum inlet communicating with said carburetor comprising:

a major chamber for containing a small volume of liquid fuel and a large volume of vaporized fuel;

a control for maintaining the level of said liquid fuel in said major chamber;

a transducer for converting a portion of said liquid fuel in said major chamber to vapor and an outlet from said major chamber;

a minor chamber communicating with said major chamber for containing a mixture of combustion supporting particles and liquid fuel;

an air intake to said minor chamber for causing air to pass through said mixture of combustion supporting particles and liquid fuel to cause said combustion supporting particles to be mixed with and entrained by fuel vapor generated by said air and;

an outlet from said minor chamber connected to said outlet from said major chamber, said outlet from said major chamber being connected to said vacuum inlet to convey said mixture of combustion supporting particles and fuel vapor into said internal combustion engine.

3. An improved fuel mixture as set forth in claim 2, wherein said combustion supporting particles are particles of metal.

4. An improved fuel mixture as set forth in claim 2, wherein said combustion supporting particles are comprised of a metal selected from the group consisting of aluminum, palladium, platinum, copper, brass or bronze and mixtures thereof.

5. An improved fuel mixture as set forth in claim 2 for use in an internal combustion engine comprising a mixture of a vaporizable fuel, air and aluminum combustion supporting particles.

6. An improved fuel mixture as set forth in claim 2 for use in an internal combustion engine comprising a mixture of a vaporizable fuel, air and nonmetallic combustion supporting particles.

7. An apparatus for improving the performance of an internal combustion engine comprising:

first fuel means for preparing a mixture of vaporized fuel and air for use in an internal combustion engine;

second fuel means for preparing a mixture of vaporized fuel, air and combustion supporting particles for use in an internal combustion engine;

mixing means for combining said mixture of vaporized fuel and air from said first fuel means with said mixture of vaporized fuel, air and combustion supporting particles from said second fuel means for use in an internal combustion engine.

8. An improved internal combustion engine comprising:

engine means for burning fuel and producing a useful output;

first fuel means for supplying a mixture of combustible fuel and air to said engine means;

second fuel means for preparing a fuel mixture comprising vaporized fuel, air and combustion supporting particles for said engine means;

vacuum means between said engine means and said first fuel means for conveying said fuel mixture from said second fuel means to said engine means;

mixing means for combining said fuel and air mixture from said first fuel means with said fuel mixture from said second fuel means and for distributing said combined fuel mixture within said engine means for use therein; and fuel supply means for supplying fuel to said first and second fuel means.

9. An improved internal combustion engine as set forth in claim 8, wherein the combustion supporting particles supplied by said second fuel means are metal particles.

10. An improved internal combustion engine as set forth in claim 8, wherein the combustion supporting particles supplied by said second fuel means are nonmetallic.

11. An improved internal combustion engine as set forth in claim 8, wherein the combustion supporting particles supplied by said second fuel means is selected from the group consisting of powdered aluminum, palladium, copper, brass, bronze and mixtures, thereof.

12. An improved internal combustion engine as set forth in claim 8, wherein the combustion supporting particles supplied by said second fuel means is powdered aluminum.

13. A method for improving the performance of an internal combustion engine comprising the following steps:, preparing a first mixture of vaporized fuel and air in a first chamber;

preparing a second mixture of vaporized fuel, air and combustion supporting particles in a second chamber;

mixing the outputs of said first and second chambers to prepare a third mixture of vaporized fuel, air and combustion supporting particles;

conveying said third mixture to the fuel and air input for the internal combustion engine for mixture with the carbureted mixture of fuel and air supplied to said internal combustion engine to improve the performance of said internal combustion engine.

14. A method for improving the performance of an internal combustion engine as set forth in claim 13, wherein said combustion supporting particles are metal particles.

15. A method for improving the performance of an internal combustion engine as set forth in claim 13, wherein said combustion supporting particles are non-metallic particles.

16. A method for improving the performance of an internal combustion engine as set forth in claim 13, wherein said combustion supporting particles are selected metal particles.

17. A method for improving the performance of an internal combustion engine as set forth in claim 13, wherein said combustion supporting particles are powdered aluminum particles.

* * * * *